US006629735B1

(12) United States Patent
Galy

(10) Patent No.: US 6,629,735 B1
(45) Date of Patent: Oct. 7, 2003

(54) SKATE WHEEL AND METHOD OF MAKING A SKATE WHEEL

(75) Inventor: Philippe Galy, Pugny-Chatenod (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/702,890

(22) Filed: Nov. 1, 2000

(30) Foreign Application Priority Data

Nov. 2, 1999 (FR) ..... 99 13965

(51) Int. Cl.[7] ..... A63C 17/32

(52) U.S. Cl. ..... 301/5.307; 301/5.301; 301/5.309

(58) Field of Search ..... 301/5.301, 5.304, 301/5.306, 5.307, 5.308, 5.309; 280/11.22, 11.23

(56) References Cited

U.S. PATENT DOCUMENTS

| | | | | |
|---|---|---|---|---|
| 5,312,844 A | | 5/1994 | Gonsior et al. | |
| 5,641,365 A | * | 6/1997 | Peterson et al. | 280/11.22 |
| 5,655,784 A | | 8/1997 | Lee | 280/11.22 |
| 5,655,785 A | | 8/1997 | Lee | 280/11.22 |
| 5,823,634 A | * | 10/1998 | Pozzobon | 301/5.304 |
| 5,908,519 A | | 6/1999 | Piper et al. | |
| 5,924,705 A | | 7/1999 | Kubelka | 280/11.22 |
| 5,938,214 A | | 8/1999 | Roman et al. | 280/11.22 |
| D433,088 S | | 10/2000 | Galy | D21/779 |
| 6,227,622 B1 | * | 5/2001 | Roderick | 301/5.301 |

FOREIGN PATENT DOCUMENTS

| | | |
|---|---|---|
| WO | WO96/20030 | 7/1996 |
| WO | 97/18937 | 5/1997 |
| WO | 98/04423 | 2/1998 |

OTHER PUBLICATIONS

"Comparative Durometers," Transworld Skateboarding, Nov. 17, 2000, by Eric Sentianin.*

* cited by examiner

*Primary Examiner*—Russell D. Stormer
(74) *Attorney, Agent, or Firm*—Greenblum & Bernstein, P.L.C.

(57) ABSTRACT

A wheel of the roller type, i.e., whose general shape is constituted by two sides the contours of which are circles with respective centers. O,O', the flanks being substantially parallel with respect to one another, substantially perpendicular to an axis OO' and connected to one another by a substantially toric surface portion having an axis of rotation OO'. The wheel is particularly intended as a wheel for a roller skate. The wheel includes a generally annular tread with an axis of rotation OO', one outer surface of which is adapted to come in contact with the ground, the tread being made of at least one first material; a generally annular hub having an axis of rotation OO' including an interface zone ensuring the cohesion of the hub and of the tread, a substantially cylindrical central surface adapted to cooperate with means fixing the wheel on a rotational shaft having an axis of rotation OO', and a hub body connecting the central surface to the interface zone, the hub being made of at least one second material, which material is different from the first; and an annular groove having an axis OO' provided on each of the sides of the wheel, the groove being limited radially on one side by the body of the hub and on the other side by the tread, and the profile of the groove being substantially triangular, trapezoidal, semi-circular or having a shape combining portions of the three preceding shapes.

22 Claims, 7 Drawing Sheets

Lr
Lsi
Lm
Li 2
11
Ri
5
3
7
1
Rg
Lg
Rr
Rsi
4
Rsc
0
0'
Lsc
13
8
10
9
14
6

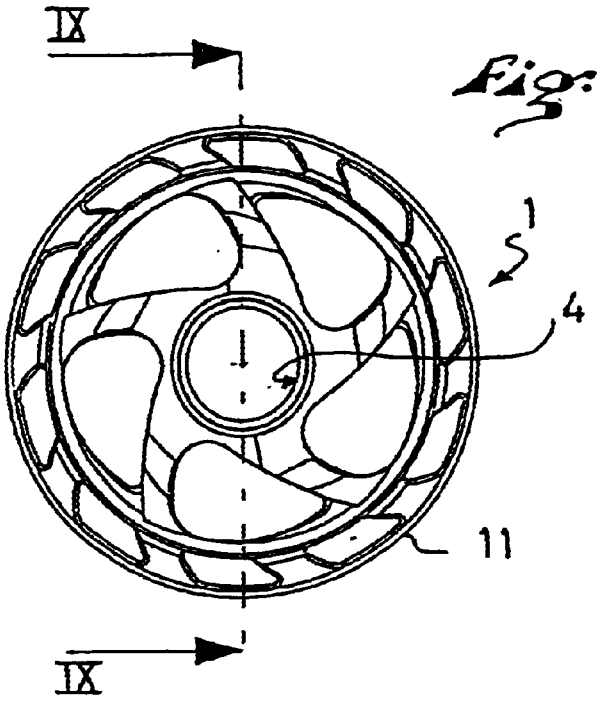
Fig. 8
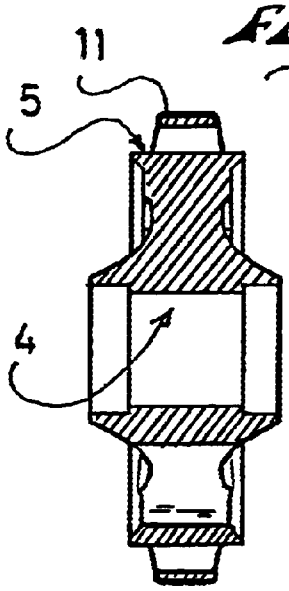
Fig. 9
Fig. 10
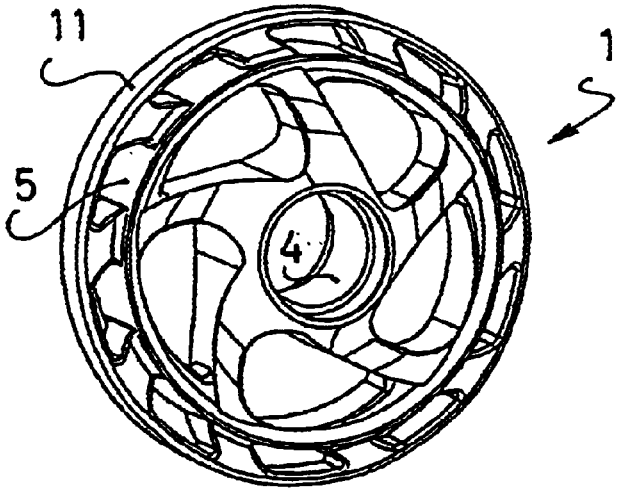

SKATE WHEEL AND METHOD OF MAKING A SKATE WHEEL

The instant application is based upon French Patent Application No. 99 13965, filed Nov. 2, 1999, the disclosure of which is hereby incorporated by reference thereto in its entirety, and the priority of which is hereby claimed under 35 U.S.C. §119.

BACKGROUND OF THE INVENTION

1. Field of the Invention

The present invention relates to a wheel primarily for a roller skate, especially for a skate whose wheels are aligned.

2. Description of Background and Relevant Information

Skate wheels are generally constituted of a hub made of a very rigid plastic material, such as polyamide, for example, on which a tread, made of one or several materials having a lower modulus of traction than that of the hub, such as polyurethane, for example, is duplicate, molded.

The characteristics which a good wheel must have are numerous. Initially, the tread must have good adherence qualities, which is particularly true for the portions thereof that are in contact with the ground in curves, i;e., when the wheel is inclined. The tread adherence depends mainly on the properties of its constituent material, i.e., on its chemical constitution, and on its macro-molecular properties.

Second, the wheel should not be overly flexible. Indeed, too much flexibility in the wheel causes a substantial deformation thereof, which negatively. affects performance, especially in terms of speed and stability.

Third, the wheel must be as resilient as possible. The resiliency of a wheel is translated into its capacity to return the maximum of the energy that is transmitted to it. This is easily appreciated by the rebounding effect of the wheel. A highly resilient wheel therefore promotes speed, because it is capable of returning a substantial portion of the energy during the expansion that follows the compression of the wheel. A non-resilient wheel absorbs much of this energy and dissipates it as heat.

Fourth, an in-line roller skate wheel must be such that the hub should not come in contact with the ground at any time during use. Indeed, in a curve and at very high speed, i.e., when the wheel is very inclined, the zone of the hub that interfaces with the tread, i.e., the peripheral zone of the hub, runs the risk of coming in contact with the ground. As a result, there is an automatic, definitive. loss of adherence.

Fifth the wheel, axle and frame assembly must be stable and should not permit any deformation, especially when the wheel is biased along a direction that is not in its median plane.

Finally, a wheel must be lightweight, and especially inexpensive to manufacture.

The document WO 96/20030 proposes to construct a skate wheel in which the lateral zones of the tread are not as hard as the central zone. Such a wheel remains heavy and especially very expensive to make.

Another document, U.S. Pat. No. 5,924,705, proposes to modify the deformability of the lateral zones of the tread by providing annular grooves on the sides thereof. Depending on the dimensions of the grooves, the use of such a wheel generates a weight gain. However, such a solution is not applicable to all wheel-profiles. Indeed, to avoid a substantial modification of the wheel behavior in curves, these annular grooves located in the tread cannot open up in a zone that comes in contact with the ground when the wheel is inclined. This is one of the reasons why a particular wheel profile was selected in this document, namely, a wheel having a substantially flat tread surface framed by substantially vertical flanks. This particular profile provides a relatively large contact surface in a straight line, which limits speed performance.

In another embodiment described in this same document, a skate wheel is provided whose rigidity can be modified by adding disks in cavities that have been especially adapted to receive them. The disks are removable and fixed on the hub by means of screws. The choice of versatility in this embodiment has led the designer to envision only one particular form of cavity, namely, a shallow cavity. Indeed, it is necessary to ensure that the residual width of the hub, in the area of the cavities, is sufficiently large to enable the positioning of the means for fixing the disks. Furthermore, such a wheel is not economical to manufacture because it requires assembling various parts, especially with screws.

The patent U.S. Pat. No. 5,938,214 proposes to reduce the lateral inclination angle of the frame/wheel assembly. To this end, two solutions are proposed.

In the first solution, an enlarged tread is duplicate molded on a conventional hub, i.e., a hub whose width enables the arrangement of two bearings and a spacer. Such an arrangement makes it possible to reduce the lateral inclination angle of the frame/wheel subassembly.

Furthermore, due to such an arrangement, the risk of contact of the hub with the ground is practically avoided. However, the necessity to enlarge the tread causes an increase in the weight of the wheels, and therefore of the skate, which is contrary to a search for performance. Moreover, such a wheel requires a specific frame, i.e., a frame including several independent pairs of wings serving to fix the axles of the wheels. The stability of the frame is reduced due to the independence of the four pairs of wings.

The second solution uses a tread having a conventional profile that is fixed to a hub that has only one bearing. In this solution, the weight gain occurs at the expense of the holding stability of the wheel on its axle.

The document U.S. Pat. No. 5,655,784 describes a skate wheel provided to be fixed on an axle by means of a single bearing, and which is equipped with a tire whose width is reduced with respect to that of the hub. Furthermore, the hardness of the material used for the tire is higher than 85 durometers on the A scale. In fact, it is comprised between 60 and 85 durometers on the D scale. Such a hardness provides the wheel with a very low resiliency and only offers very little adherence to the user of this wheel. Furthermore, the presence of a single bearing requires the use of a bearing having a very large outer diameter, and does not offer an optimum stability to the skate, especially when the latter is biased along a direction that is not in the longitudinal plane of the skate.

The standard wheels that are commonly used on the in-line roller skates have a hub about 24 millimeters (mm) wide, and whose outer diameter varies generally between 38 and 45 mm. This is a diameter that does not take into account the interlock that is embedded in the tread. This value is to be applied to the total outer diameter of a wheel that varies approximately between 72 mm and 82 mm. Indeed, it is estimated that to eliminate the risk of contact of the hub with the ground, the outer diameter of the hub should not exceed 60% of the value of the total outer diameter of the wheel, and preferably should not exceed 55%. The wheels that have a hub larger than 45 mm and whose diameter does not exceed 82 mm put the user at a great risk of hub/ground contact.

Furthermore, the standard wheels are mounted on an axle by means of two roller bearings whose diameter is less than or equal to 22 millimeters. The two bearings are arranged at a distance from one another at both ends of the inner surface of the hub.

For economical reasons, the manufacture of the largest portion of the skate wheels calls for the techniques of duplicate molding of plastic materials. The hub is first obtained by plastic molding or injection; the tread is then duplicate molded. Gravity molding along a feed bush is then used. After demolding, a sprue remains, which is located on one of the flanks of the wheel, in the area of the hub/tread interface. This sprue is then cut along a direction perpendicular to the axle of the wheel. Manufacturing the skate wheels by duplicate molding makes it possible to produce wheels that have satisfactory performances at low cost. However, it does not make it possible to obtain wheels having a particular profile, especially because of the cutting of the sprue that is perpendicular to the axle of the wheel.

SUMMARY OF THE INVENTION

An object of the present invention is to overcome the aforementioned disadvantages. This means designing a wheel that benefits from a very good adherence, even when substantially inclined, and which enables a weight gain.

This also means designing a wheel which, even when it is used in standard configurations, allows for an increase in the outer diameter of the hub, in the sense defined hereinabove. The present invention also includes a method of manufacturing that makes it possible to obtain such a wheel.

To resolve the problem posed, a wheel is provided, which includes: a generally annular tread having an axis of rotation OO'; a generally annular hub having an axis of rotation OO' including an interface zone ensuring the cohesion of the hub and of the tread, a substantially cylindrical central surface adapted to cooperate with a mechanism for fixing the wheel on a rotation shaft having an axis OO', and a hub body connecting the central surface to the interface zone; an annular groove having an axis of rotation OO', limited radially on one side by the hub body, and on the other side, at least partially, by the tread; the groove having a profile that is substantially triangular, trapezoidal, semi-circular or a shape combining portions of the three preceding profiles.

Since the annular groove is not provided only in the tread or in the hub, but in both at the same time, one can therefore increase the volume recessed by the groove and thus obtain a more substantial weight gain in comparison to the wheels known from the state of the art. Moreover, due to its smaller width, the hub/tread interface surface no longer runs the risk of coming in contact with the ground when the wheel is inclined. Furthermore, for a given wheel diameter, a hub having a larger diameter can be used. In view of the differences in density and rigidity between the materials that are commonly used for the hub and the tread, a weight gain approximating 20% can be obtained due to the wheel according to the invention.

The bottom of the annular groove, i.e., the assembly of the deepest points, is a circle whose center is located on the axis OO'. The latter is located on the: lateral surface of the hub, at a distance from the hub/tread interface surface. In a preferred embodiment of the invention, the depth of the groove is at least greater than 20% of its width. Advantageously, an annular groove is provided on each of the flanks, these two grooves having a symmetrical position relative to one another with respect to the median plane of the wheel. The bottom of these two annular grooves corresponds to the area where the width of the hub is the smallest. Preferably, this smallest width Lm of the hub is less than the width of the tread in the area of the tread/hub interface, also called the width Lsi of the interface surface.

Preferably, the tread includes a material whose hardness is comprised between about 60 and about 90 Shore A.

Preferably, the central limit of the annular groove is located in the vicinity of the central surface of the hub. In other words, it is said that radially, the annular groove begins in the vicinity of the central surface of the hub.

The peripheral limit of the groove is located on the tread. In a preferred embodiment, this peripheral limit corresponds with the central limit of the surface of the tread that is capable of coming in contact with the ground. Preferably, this peripheral limit is positioned such that the difference between the radius of the wheel and the radius of the peripheral limit of the groove is substantially equal to half the width of the wheel, when taken in the area of the tread.

Advantageously, the hub body is not solid, but bored by cavities that may or may not be through cavities. For reasons of simplicity, the surface constituting the lateral outer contour of the hub will continue to be referred to as lateral surface of the hub in the rest of the disclosure and in the claims, i.e., regardless as to whether or not cavities are provided in the hub body.

Since the groove is limited radially, on one side by the hub and on the other side by the tread, the surface of the groove includes a central portion constituting a portion of the lateral surface of the hub body, and a peripheral portion constituting a portion of the outer surface of the tread. As for the lateral surface of the hub, whether or not the latter is bored by cavities, one will refer to a central portion of the surface of the groove. The central portion of the wall of the groove as well as its peripheral portion can have different profiles. However, the peripheral portion will preferably be given the profile of a straight portion, whereas the central portion will have a curved profile To resolve the problem posed, one also provides a roller skate wheel constituted of a tread and a hub, the hub including an interface zone ensuring the cohesion of the hub and of the tread, a substantially cylindrical central surface adapted to cooperate with means fixing the wheel on a rotation shaft Hand a hub body connecting the inner surface to the interface surface, the interface zone including a substantially cylindrical interface surface on which the tread rests, the width of the interface surface is smaller, than 90% of the width of the central surface. In a preferred embodiment, the interface surface has a width smaller than 80% of the width of the central surface.

Preferably, the material of the tread is a polyurethane elastomer defined by the following intrinsic characteristics: an elastic modulus E" comprised between about 6 and about 11.3, and a viscous modulus E" lower than about 0.25. Furthermore, for reasons of comfort, it is preferable to use materials whose hardness does not exceed about 85 shore A to manufacture the tread. To prevent early wear and tear and to maintain a good resiliency in the wheel, one selects materials whose hardness is greater than about 60 Shore A.

The invention also provides for a skate wheel that includes a generally annular hub including an axis of rotation and a substantially cylindrical central surface adapted to cooperate with a mechanism for fixing the wheel on a shaft. The hub includes a first material. A generally annular tread is mounted to the hub and has at least one outer surface adapted to contact a ground surface. The tread includes a second material which is different from the first material and whose hardness is between about 60 and about 85 Shore A. A connecting interface zone is defined between the hub and the tread. At least one annular groove has an axis which corresponds to the axis of rotation of the hub. The at least one groove is arranged on at least one side of the skate wheel in the area of the connecting interface zone. The connecting interface zone includes an interface surface on which the tread rests. A width of the interface surface is smaller than a maximum width of the tread. In the interface zone, a peripheral portion of the tread and a peripheral portion of the hub are tangent to one another.

Moreover, to make a wheel according to the invention, a method is provided, which includes the following: obtaining the hub by molding, injection, gravity casting, extrusion, stamping, forging or diecasting; arranging the hub in a lower mold, whose shape corresponds exactly to the final shape which one wishes to impart to a first half of the tread; closing the mold by positioning an upper mold 21, whose shape corresponds essentially to the final shape which one wishes to impart to the second half of the tread, minus the zone(s) corresponding to the sprue(s), the parting line being perpendicular to the axis of the wheel to be manufactured; gravity casting of the material of the tread by way of a feed bush; the method further including: cutting the sprue along at least one direction that is not parallel to the parting line.

The cutting of the sprue, which is not parallel to the parting line, makes it possible to manufacture, using the gravity casting method, wheels that have a complex profile.

The invention therefore provides for a skate wheel comprising a generally annular hub including an axis of rotation and a substantially cylindrical central surface adapted to cooperate with a mechanism for fixing the wheel on a shaft, the hub including a first material, a generally annular tread mounted to the hub and having at least one outer surface adapted to contact a ground surface, the tread including a second material which is different from the first material and whose hardness is comprised between about 60 and about 85 Shore A, a connecting interface zone being defined between the hub and the tread, at least one annular groove having an axis which corresponds to the axis of rotation of the hub, the at least one groove being arranged on at least one side of the skate wheel in the area of the connecting interface zone, and the at least one groove having a profile, wherein the profile of the at least one groove comprises a shape which is one of substantially triangular, substantially trapezoidal, substantially semi-circular, and combines portions which are substantially triangular, substantially trapezoidal, and substantially semi-circular.

The interface zone may include an interface surface on which the tread rests, and a width of the interface surface may be smaller than about 80% of a width of the cylindrical central surface, and the hub may have a width in the area of the groove which is smaller than the width of the interface surface. The tread may be duplicate molded on the hub. The hub may be made of a single piece. The hub may comprise a plurality of cavities. Each of the cavities may extend through the hub from one side to another side. The profile may extend from the hub to the outer surface of the tread. The profile may include a straight portion arranged on the tread and a curved portion arranged on the hub. A depth of the at least one groove may be greater than or equal to about 20% of a width of the at least one groove. A depth of the at least one groove may be greater than about 15% of a width of the cylindrical central surface. The profile in the area of the tread may comprise a straight portion. The profile may comprise a curved portion. The profile may comprise at least a partially circular portion. A bottom of the at least one groove may be circular. A bottom of the groove may be circular and may be arranged on the outer surface of the tread. The interface zone may include a substantially cylindrical interface surface and an interlock having a substantially annular general shape arranged radially away from the cylindrical interface surface. A width of the interlock may be greater than about 40% of a width of the cylindrical interface surface. The mechanism for fixing the skate wheel on the shaft may comprise a pair of roller bearings arranged within the cylindrical central surface.

The invention also provides for a method for manufacturing a skate wheel having a hub with a rotation axis and a tread attached to the hub, the method comprising forming the hub via at least one of molding, injection, gravity casting, extrusion, stamping, forging, and diecasting, positioning the hub in a lower mold, the lower mold having a shape which corresponds to half of a desired final shape of the tread, positioning an upper mold on the lower mold, the upper mold having a shape which corresponds essentially to half of a desired final shape of the tread, less at least one zone corresponding to a sprue, a parting line of the tread being perpendicular to the rotation axis of the hub, gravity casting of a material which will form the tread utilizing a feed bush, and removing the sprue.

The removing may comprise cutting the sprue via a plurality of cuttings, each of the cuttings occurring along a same direction.

The invention also provides for a skate wheel comprising a hub made of a first material and having a substantially cylindrical central surface adapted to cooperate with a mechanism for fixing the wheel on a shaft, a tread attached to the hub and having at least one outer surface adapted to contact a ground surface, the tread including a second material which is different from the first material and whose hardness is comprised between about 60 and about 85 Shore A, a connecting interface zone being defined between the hub and the tread, at least one annular groove arranged on each side of the connecting interface zone, each of the at least one annular groove having an axis which corresponds to the axis of rotation of the hub and having a profile, wherein the profile of the at least one groove comprises a shape which is one of substantially triangular, substantially trapezoidal, substantially semi-circular, and a combination of portions which are substantially triangular, substantially trapezoidal, and substantially semi-circular.

The invention further contemplates a skate wheel comprising a hub having a substantially cylindrical central surface adapted to cooperate with a mechanism for fixing the wheel on a shaft, a tread attached to the hub and having at least one outer surface adapted to contact a ground surface, a connecting interface zone being defined between the hub and the tread, at least one annular groove arranged on each side of the connecting interface zone, each of the at least one annular groove having an axis which corresponds to the axis of rotation of the hub and having a profile, and a smallest width of the skate wheel being defined between a lowest portion of one groove on one side of the interface zone and a lowest portion of another groove on another side of the interface zone, wherein the smallest width is arranged in the hub.

The invention additionally provides for a skate wheel comprising a hub having a substantially cylindrical central surface adapted to cooperate with a mechanism for fixing the wheel on a shaft, a tread attached to the hub and having at least one outer surface adapted to contact a ground surface, a connecting interface zone being defined between the hub and the tread, at least one annular groove arranged on each side of the connecting interface zone, each of the at least one annular groove having an axis which corresponds to the axis of rotation of the hub and having a profile, and a smallest width of the skate wheel being defined between the cylindrical central surface and the outer surface of the tread, wherein a lower most portion of each groove is at least one of curved, circular, and partially circular.

The invention provides for a skate wheel comprising a hub having a substantially cylindrical central surface adapted to cooperate with a mechanism for fixing the wheel on a shaft, a tread attached to the hub and having at least one outer surface adapted to contact a ground surface, a connecting interface zone being defined between the hub and the tread, at least one annular groove arranged on each side of the connecting interface zone, each of the at least one annular groove having an axis which corresponds to the axis of rotation of the hub and having a profile, and a smallest width of the skate wheel being defined between the cylindrical central surface and the outer surface of the tread, a smallest width of the skate wheel being defined between the cylindrical central surface and the outer surface of the tread, wherein a widest portion of the hub, parallel to the rotation axis, is substantially approximately equal to a widest portion of the tread.

The invention also contemplates a skate wheel comprising a hub having a substantially cylindrical central surface adapted to cooperate with at least two bearing devices for fixing the wheel on a shaft, a tread attached to the hub and having at least one outer surface adapted to contact a ground surface, a connecting interface zone being defined between the hub and the tread, at least one annular groove arranged on each side of the connecting interface zone, each of the at least one annular groove having an axis which corresponds to the axis of rotation of the hub and having a profile, and a smallest width of the skate wheel being defined between a lowest portion of one groove on one side of the interface zone and a lowest portion of another groove on another side of the interface zone.

The invention still further contemplates a skate wheel comprising a hub having a substantially cylindrical central surface arranged between two shoulder portions, each shoulder portion being adapted to cooperate with a bearing device for fixing the skate wheel on a shaft, a tread having a curved outer surface and being attached to the hub, an interface zone being defined wherein the hub is attached to the tread, at least one annular groove arranged on each side of the connecting interface zone, each of the annular grooves having an axis which corresponds to the axis of rotation of the hub, and a smallest width of the skate wheel being defined between a surface on one side of the hub and another surface on another side of the hub, wherein each groove comprises a shape which is one of substantially triangular, substantially trapezoidal, substantially semi-circular, and a combination of portions which are substantially triangular, substantially trapezoidal, and substantially semi-circular.

BRIEF DESCRIPTION OF DRAWINGS

The invention will be better understood and other characteristics thereof will become apparent from the description that follows, with reference to the annexed schematic drawing s that show a plurality of embodiments, by way of non-limiting examples, and in which:

FIGS. 8, 9, and 10 show the front view, a radial cross-sectional view and a perspective view, respectively, of the hub of a wheel according to a sixth embodiment;

DETAILED DESCRIPTION OF THE INVENTION

Figure 1:
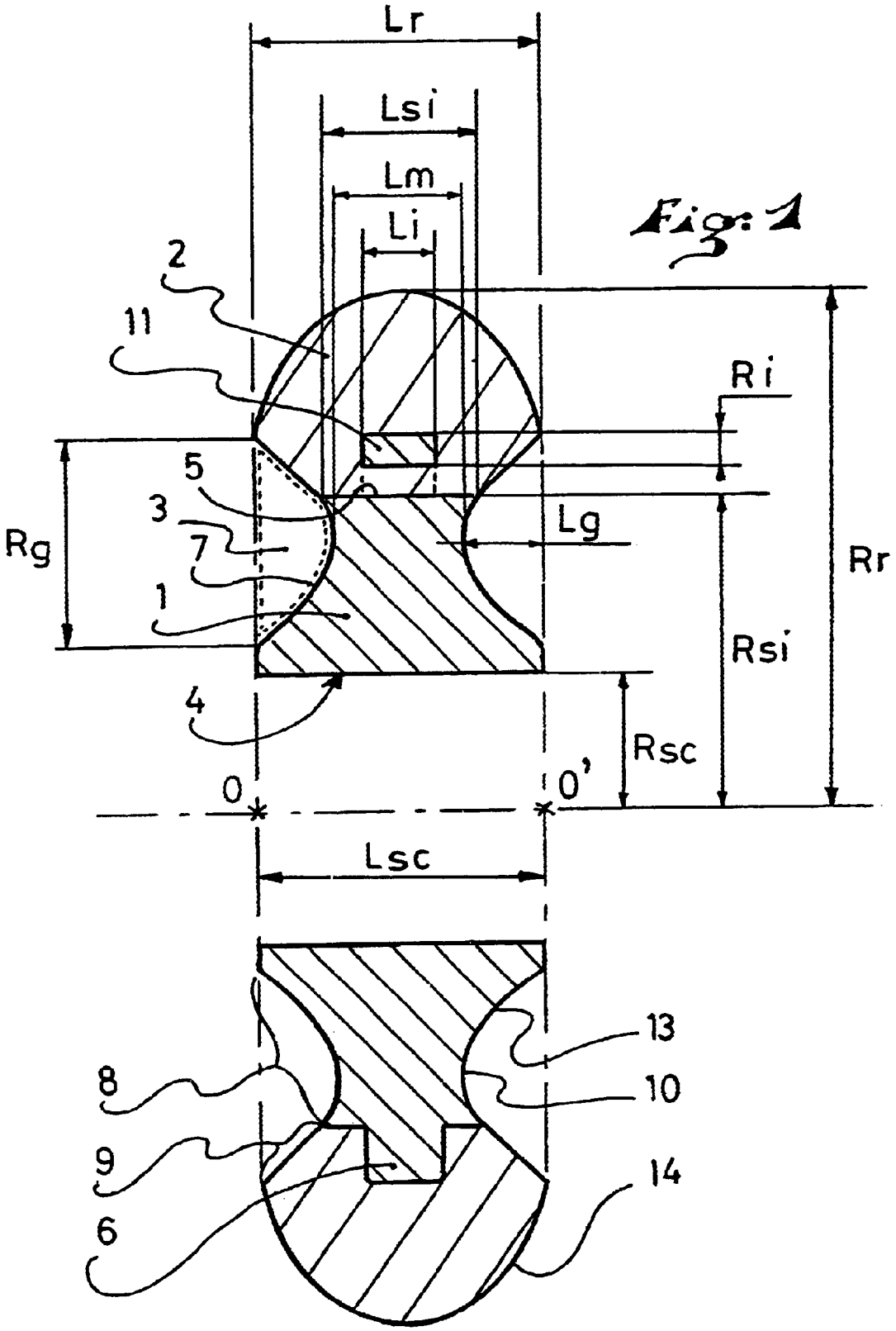
FIG. 1 shows a cross-sectional view of a wheel according to a first embodiment.

The section of the wheel presented in cross-section in FIG. 1 is shown schematically in order to clearly separate the characteristics of the invention. The wheel is constituted of a hub 1 on which a tread 2 is fixed. The hub 1 has a generally annular shape with an axis of rotation OO'. It includes an interface zone ensuring the cohesion between the hub 1 and the tread 2, a substantially cylindrical central surface 4 adapted to cooperate with a mechanism for fixing the wheel on a rotation shaft (not shown) having axis OO' and a hub body connecting the central surface to the interface zone.

The interface zone between the hub 1 and the tread 2 includes an interface surface 5 having a substantially cylindrical general shape and an interlock 6 having a substantially annular general shape extending radially from the interface surface 5. For weight related reasons, and to increase the hub/tread contact area, the interlock 6 is generally constituted by a belt 11 connected to the interface surface by a plurality of substantially radial posts 12 (see FIG. 5). An annular groove 3, whose profile is defined by a contour in dotted lines in FIG. 1, is provided on each of the flanks of the wheel. According to the invention, the groove 3 is limited radially on one side by the hub 1 and on the other side by the tread 2.

The wall 7 of the groove 3 is therefore broken down into a central portion 8 that constitutes a portion of the lateral surface 13 of the body of the hub 1, and a peripheral portion 9 that constitutes a portion of the outer surface 14 of the tread 2. The depth Lg of the groove 3 is at least greater than about 20% of the width Lsc of the central surface 4. The peripheral portion 9 of the wall 7 of the groove 3 has a straight profile, whereas the central portion 8 has a curved profile. The width Lsi of the interface surface 5 is comprised between about 20% and about 80% of the width Lsc of the central surface 4, preferably between about 40% and about 60%.

Furthermore, the general profile of the groove 3 is a substantially triangular profile in which the profile of the central portion has a substantially rounded portion. The bottom 10 of the groove 3 is a circle whose center is on the axis OO'. The smallest width of the hub 1 is in the area of the bottom 10 of the two annular grooves 3 arranged on both sides of the wheel. This width, designated by the reference Lm in FIG. 1, is smaller than the width Lsi of the interface surface 5. On the other hand, the maximum width of the tread 2, designated by the reference Lr in the figure, is substantially equal to the width Lsc of the central surface 4, which corresponds to the maximum width of the hub 1.

Figure 2:
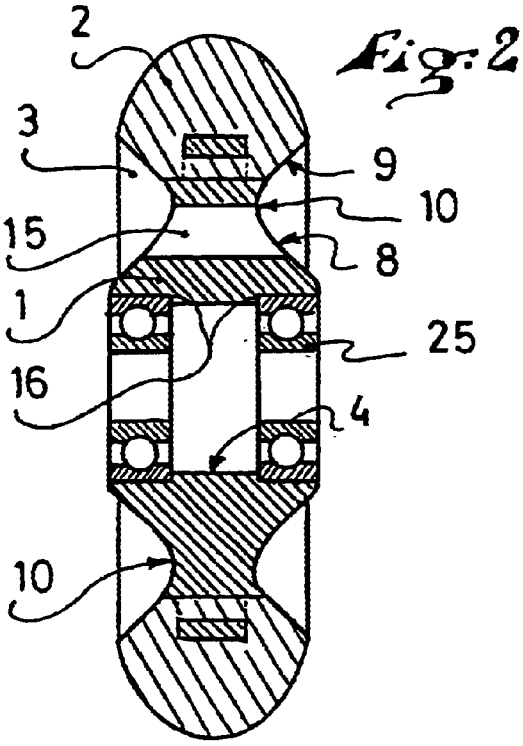
FIG. 2 shows a cross-sectional view of a wheel according to a second embodiment.

FIG. 2 shows a skate wheel whose hub 1 is in a single piece and through which substantially cylindrical cavities 15 extend. Roller bearings 25 of the ball bearing type are provided and are in the number of two, arranged at the two axial ends of the central surface of the hub 1. Moreover, to ensure the abutment of the outer retainers of the roller bearings 25, two shoulders 16 are provided in the central surface 4 of the hub 1. This arrangement of the bearings 25 provides the wheel with an increased stability, even when the skater is in the thrust phase and the wheel is biased along a direction that is not in its median plane. Two shoulders 16 divide the central surface 4 into three cylindrical surfaces.

The peripheral portion 9 of the wall 7 of the groove 3 has a straight profile; it does not include any acute angle, whereas the central portion 8 has a curved profile. The width Lsi of the interface surface 5 corresponds approximately to 50% of the width Lsc of the central surface 4. The volume of the interlock 6 is increased to avoid problems, such as the buckling of the wheel or the weakening thereof, caused by the narrowing of the hub 1 and the presence of cavities.

Preferably, the interlock 6 is provided with a width Li greater than about 40% of the value of the width Lsi of the interface surface 5. The volume of the interlock 6 can also be increased by increasing its height Ri. On the other hand, the use of a material that is substantially more rigid than those commonly used to manufacture the hub 1 eliminates the need for such an increase in the volume of the interlock 6. The bottom 10 of each of the annular grooves 3 is a circle located on the outer surface of the hub 1. The width Lr of the wheel is substantially equal to the width Lsc of the central surface of the hub 1. In fact, it is substantially less in a proportion such that: $0.8\ Lsc<Lr<Lsc$.

The material used for the tread 2 is a polyurethane elastomer whose hardness is comprised between about 60 Shore A and about 85 Shore A, whereas the hub 1 is made of plastic.

Figure 3:
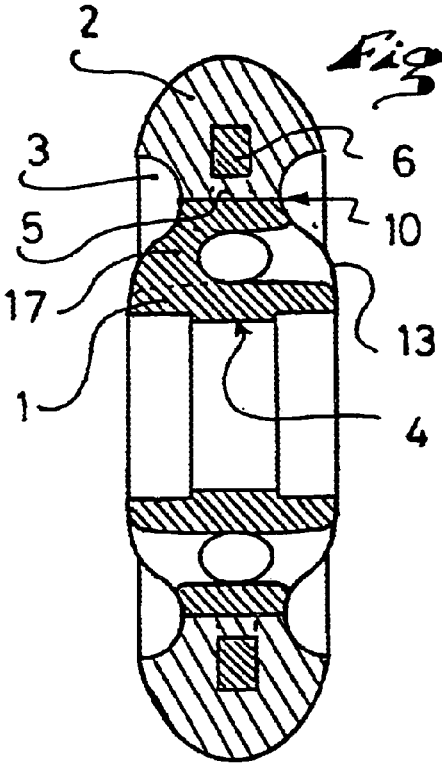
FIG. 3 shows a cross-sectional view of a wheel according to a third embodiment.

FIG. 3 shows a third embodiment of the invention in which the bottom 10 of each of the grooves 3 provided on the flanks of the wheel is located precisely in the area of the interface surface 5. The wall 7 of the annular groove 3 has an arc of a circle profile on its portion that coincides with the outer surface 14 of the tread 2. The lateral surface 13 of the hub 1 has a profile constituted of two arc of a circle portions. The hub body 1 has a geometry that resembles the structure of a bicycle wheel, in the sense that the junction between the central surface 4 of the hub 1 and the interface zone is obtained due to lateral arms 17 arranged alternately on one, then the other side of the wheel. To improve the lateral rigidity and increase its inertia, an interlock 6 is provided, whose height Ri is larger than its width Li.

Figure 4:
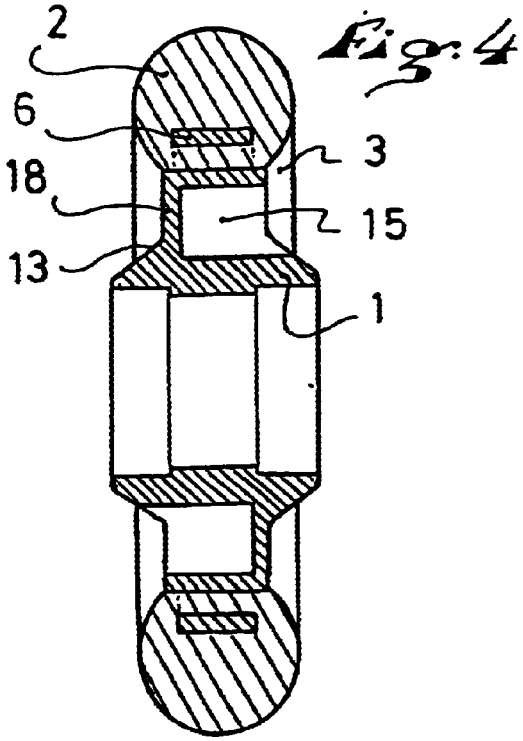
FIG. 4 shows a cross-sectional view of a wheel according to a fourth embodiment.

FIG. 4 shows a fourth embodiment of the invention in which the tread 2 has a substantially circular profile. The lateral surface 13 of the hub is constituted essentially of two substantially vertical flanges 18. Therefore, the profile of the groove 3 is, in this case, a trapezoid portion that is extended by an arc of a circle portion in the area of the tread 2. The width of the tread 2 is substantially less than the width of the central surface 4 of the hub 1. The hub body is entirely constituted of non-through cavities 15 that open up alternately on one or the other side of the wheel. Such a structure makes it possible to optimize the rigidity of the structure of the hub 1 while reducing the thickness of the walls separating the cavities 15 from one another. The width Li of the interlock 6 is practically equal to the width Lsi.

Figure 5:
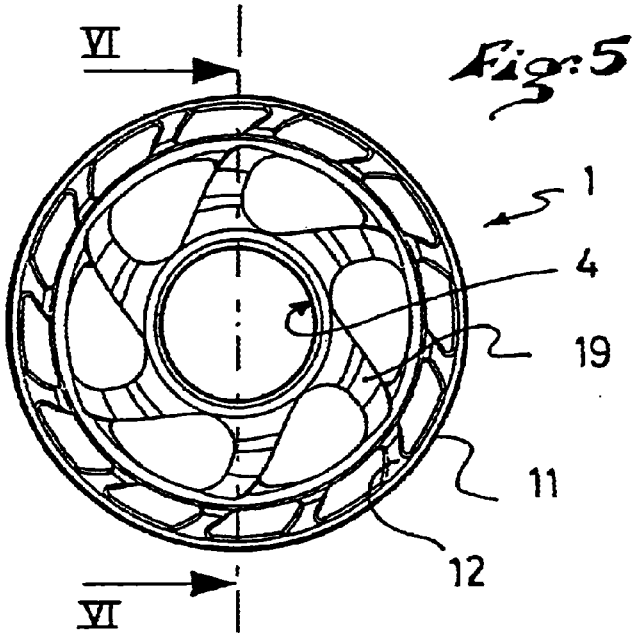
FIGS 5, 6, and 7 show the front view, a radial cross-sectional view and a perspective view, respectively, of the hub of a wheel according to a fifth embodiment of the invention.
Figure 6:
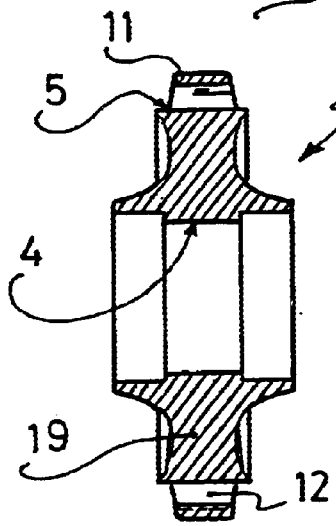
Figure 7:
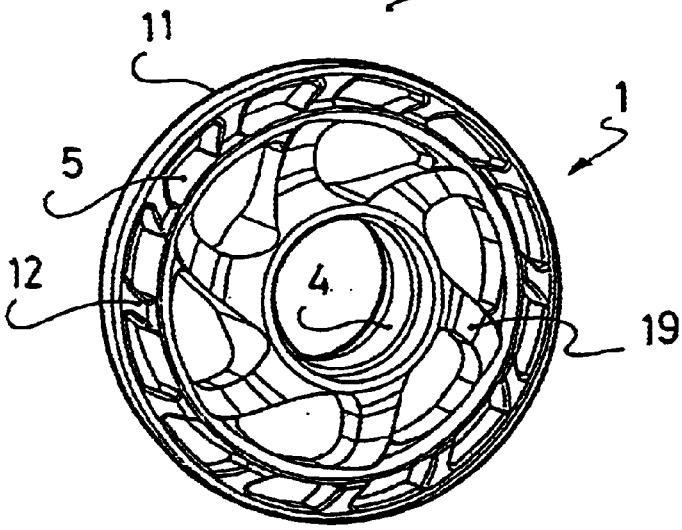

FIGS. 5, 6, and 7 show the front view, a radial cross-sectional view and a perspective view, respectively, of the hub 1 of a wheel according to a fifth embodiment of the invention. The body of the hub 1 is constituted of six shaped arms 19. The interlock includes a belt 11 connected to the interface surface 5 by twelve posts 12 having a lateral contour similar to that of the arms 19. Preferably, some of the posts 12 are located in the extension of the arms 19. The central surface 4 is provided to receive the two bearing retainers 22 mm in diameter as well as a spacer (not shown).

The advantages provided by the invention are independent of the type and dimensions of the bearing retainers used for mounting the wheel according to the invention on an axle. Adopting bearings with a smaller diameter, such as a bearing 16 mm in diameter, for example, generates a more substantial weight gain. FIGS. 8, 9, and 10 show the front view, a radial cross-sectional view, and a perspective view, respectively, of the hub 1 of a wheel according to a sixth embodiment of the invention. This hub 1 involves a construction similar to that of the preceding embodiment. Cavities 15 are provided and separated from one another by shaped arms 19. The bottom 10 of the groove is located on the lateral surface 13 of the hub 1. The central surface 4 is provided to receive bearing retainers 16 mm in diameter.

Figure 11:
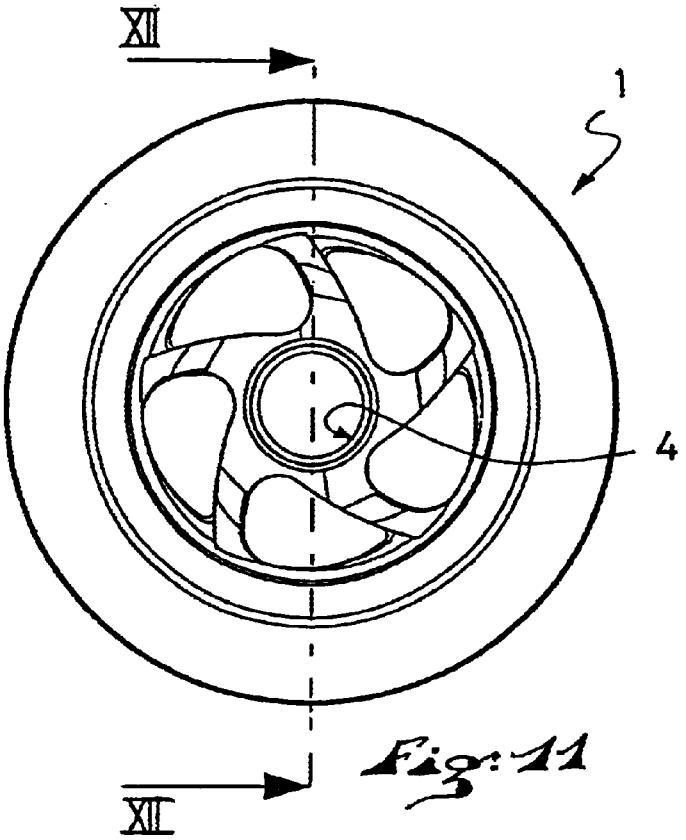
FIGS. 11, 12, and 13 show the front view, a radial cross-sectional view and a perspective vie, respectively, of a complete wheel according to the invention and using the hub shown in FIGS. 8–10.
Figure 12:
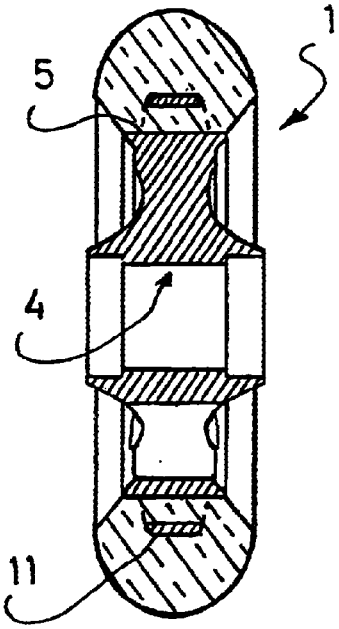
Figure 13:
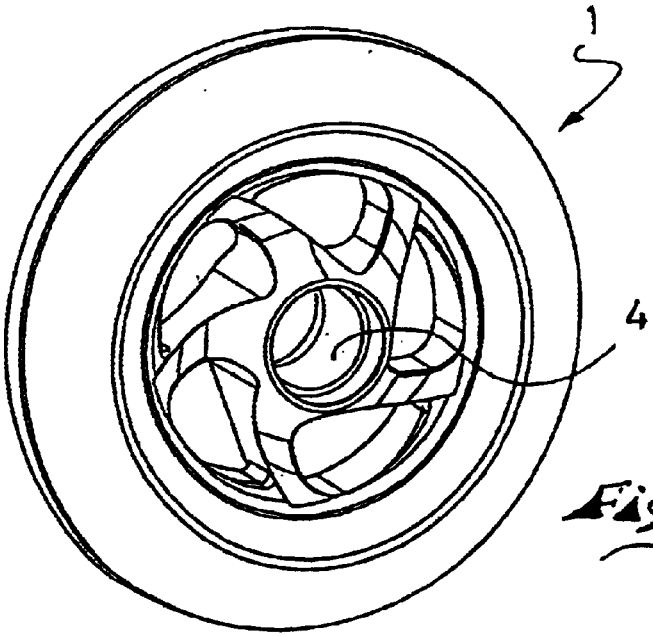
Figure 14:
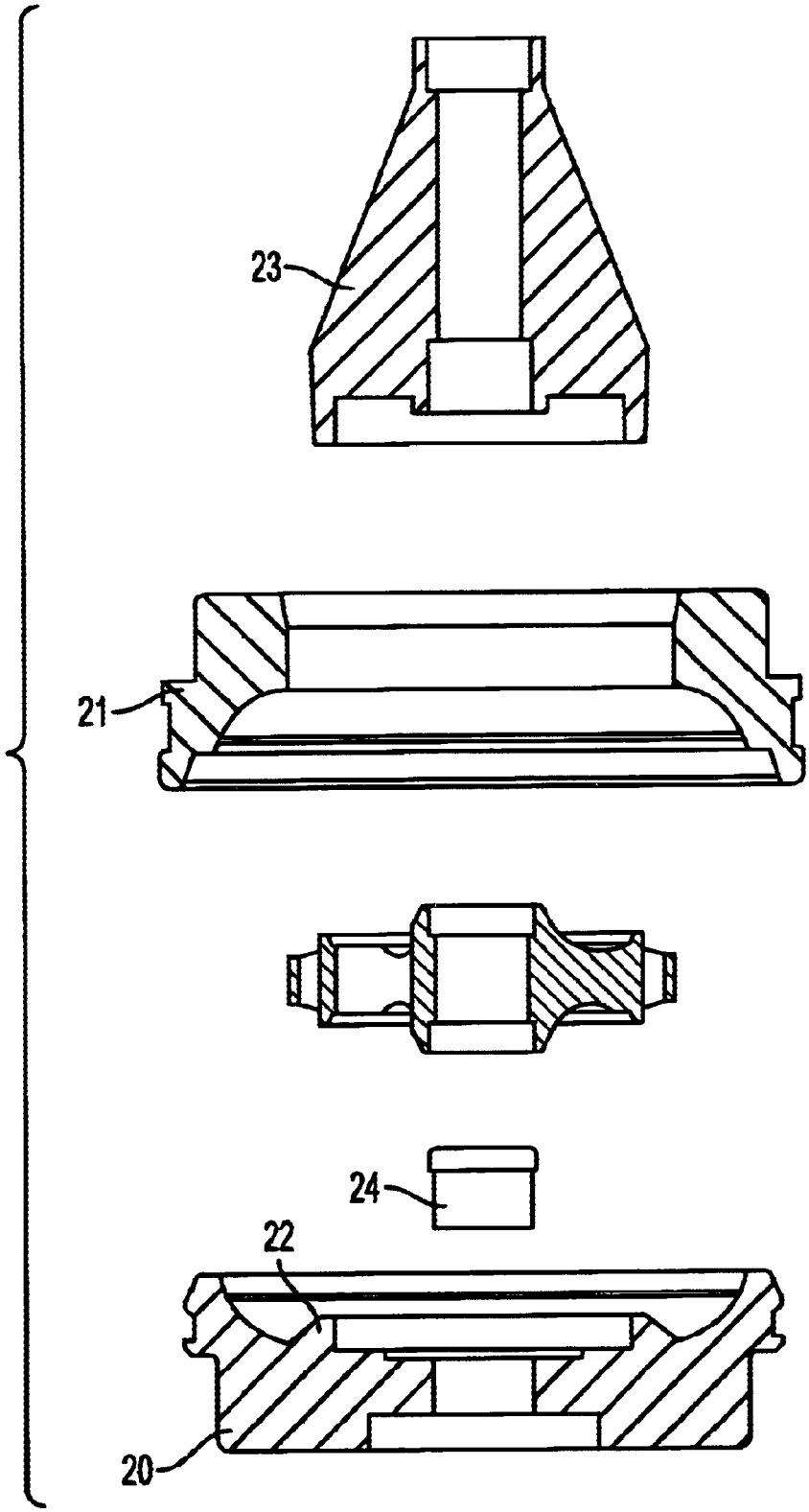
FIG. 14 shows an exploded cross-sectional view of the various parts before the molding phase of the tread on the hub.
Figure 15:
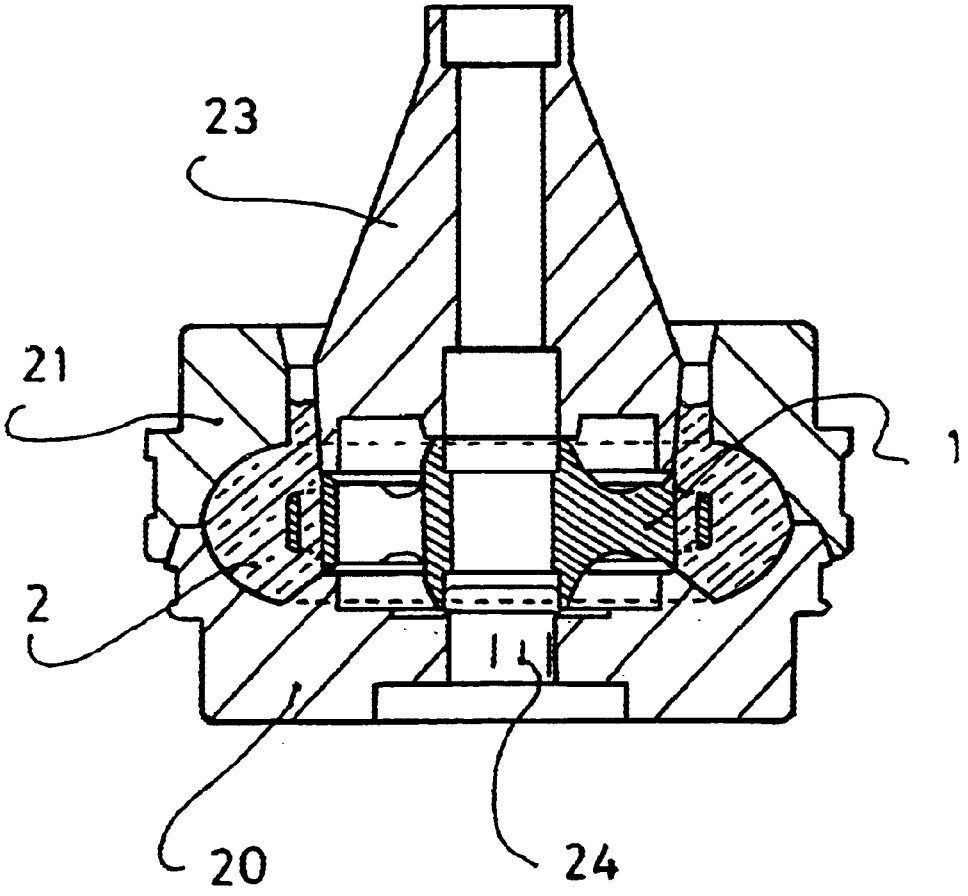
FIG. 15 is a cross-sectional view of the same parts after the casting of the material of tread.

Given that the central limit of the annular groove 3 is located directly in the vicinity of the central surface 4 of the hub 1, the use of bearings having a smaller outer diameter makes it possible to increase the width Rg of the groove 3 and, therefore, the weight gain. FIGS. 11, 12, and 13 show the front view, a radial cross-sectional view, and a perspective view, respectively, of a complete wheel according to the invention and using the hub 1 shown in FIGS. 8–10.

The manufacture of a wheel according to the invention includes at least manufacturing the hub 1, molding the tread 2, and finishing. The hub 1 can be made of various materials, especially aluminum, polyamide, polyurethane, polybutyleneterephthalate, polycarbonate, or a magnesium or titanium alloy. This hub 1 can be obtained by molding, injection, gravity casting, extrusion or stamping, forging or diecasting. The hub is then placed in a lower mold 20, the centering being ensured by a centering pin 24. The shape of the lower mold 20 corresponds exactly to the final shape which one wishes to impart to the tread 2, i.e., the lower mold 20 distinguishes over a conventional mold by the presence of an annular edge 22 on which the peripheral surface of the hub 1 takes support.

The upper mold 21 is then positioned. A feed bush 23 takes support on the hub 1 defining an annular opening through which the material of the tread 2 can be cast or injected. After demolding, the sprue is cut using a thin blade so as to obtain the desired profile. In the case where the profile of the portion of the groove 3 that coincides with the tread 2 does not have an acute angle, cutting with the blade does not pose any particular problem. Otherwise, or in the case where this profile is more complex, a cutting of the sprue can be more difficult and more expensive to implement. One then turns to a different technique that consists of using a punch (not shown) having an imprint of the desired surface and the outer dimensions of the feed bush 23. Immediately after the casting of the material of the tread 2, the introduction of the puncher in the feed bush 23 will possibly flush out the excess material and will provide the tread 2 with the desired profile.

The present invention is not limited to the preceding examples of embodiments that are presented in this disclosure for guidance only. For example, it is clear that the advantages provided by the invention are independent of the configuration selected for the hub, i.e., the shape and the number of cavities, the dimensions of the interlock, the materials used. They are also independent of the type and number of the materials selected for the tread. In

NOMENCLATURE

1—Hub
2—Tread
3—Annular groove
4—Central surface
5—Interface surface
6—Interlock
7—Wall
8—Central portion
9—Peripheral portion
10—Bottom
11—Belt (of the interlock)
12—Post (of the interlock)
13—Lateral surface (of the hub body)
14—Outer surface (of the tread)
15—Cavities
16—Shoulder
17—Lateral arms
18—Flange
19—Shaped arm
20—Lower mold
21—Upper mold
22—Annular edge
23—Feed bush
24—Centering pin
25—Roller bearings

What is claimed is:

1. A skate wheel comprising:

a generally annular hub including an axis of rotation and a substantially cylindrical central surface adapted to cooperate with a mechanism for fixing the wheel on a shaft;

the hub including a first material;

a generally annular tread mounted to the hub and having at least one outer surface adapted to contact a ground surface;

the tread including a second material which is different from the first material and whose hardness is comprised between about 60 and about 85 Shore A;

a connecting interface zone being defined between the hub and the tread;

at least one annular groove having an axis which corresponds to the axis of rotation of the hub;

the at least one groove being arranged on at least one side of the skate wheel in the area of the connecting interface zone, wherein the connecting interface zone includes an interface surface on which the tread rests, a width of the interface surface being smaller than a maximum width of the tread, wherein, in the interface zone, a peripheral portion of the tread and a peripheral portion of the hub are tangent to one another, and wherein the hub has a width in the area of the groove which is smaller than the width of the interface surface.

2. The wheel of claim 1, wherein the tread is duplicate molded on the hub.

3. The wheel of claim 1, wherein the hub is made of a single piece.

4. The wheel of claim 1, wherein the hub comprises a plurality of cavities.

5. The wheel of claim 4, wherein each of the cavities extends through the hub from one side to another side.

6. The wheel of claim 1, wherein the profile extends from the hub to the outer surface of the tread.

7. The wheel of claim 1, wherein a depth of the at least one groove is greater than or equal to about 20% of a width of the at least one groove.

8. The wheel of claim 1, wherein a depth of the at least one groove is greater than about 15% of a width of the cylindrical central surface.

9. The wheel of claim 1, wherein the profile in the area of the tread comprises a straight portion.

10. The wheel of claim 1, wherein the profile comprises a curved portion.

11. The wheel of claim 1, wherein the profile comprises at least a partially circular portion.

12. The wheel of claim 1, wherein a bottom of the at least one groove is circular.

13. The wheel of claim 1, wherein a bottom of the groove is circular and is arranged on the outer surface of the tread.

14. The wheel of claim 1, wherein the interface zone includes a substantially cylindrical interface surface and an interlock having a substantially annular general shape arranged radially away from the cylindrical interface surface.

15. The wheel of claim 14, wherein a width of the interlock is greater than about 40% of a width of the cylindrical interface surface.

16. The wheel of claim 1, wherein the mechanism for fixing the skate wheel on the shaft comprises a pair of roller bearings arranged within the cylindrical central surface.

17. A skate wheel comprising:

a generally annular hub including an axis of rotation and a substantially cylindrical central surface adapted to cooperate with a mechanism for fixing the wheel on a shaft;

the hub including a first material;

a generally annular tread mounted to the hub and having at least one outer surface adapted to contact a ground surface;

the tread including a second material which is different from the first material and whose hardness is comprised between about 60 and about 85 Shore A;

a connecting interface zone being defined between the hub and the tread;

at least one annular groove having an axis which corresponds to the axis of rotation of the hub;

the at least one groove being arranged on at least one side of the skate wheel in the area of the connecting interface zone, wherein the connecting interface zone includes an interface surface on which the tread rests, a width of the interface surface being smaller than a maximum width of the tread, wherein, in the interface zone, a peripheral portion of the tread and a peripheral portion of the hub are tangent to one another, and wherein the profile includes a straight portion arranged on the tread and a curved portion arranged on the hub.

18. A skate wheel comprising:

a hub having a substantially cylindrical central surface adapted to cooperate with a mechanism for fixing the wheel on a shaft;

a tread attached to the hub and having at least one outer surface adapted to contact a ground surface;

a connecting interface zone being defined between the hub and the tread;

at least one annular groove arranged on each side of the connecting interface zone;

each of the at least one annular groove having an axis which corresponds to the axis of rotation of the hub and having a profile; and a smallest width of the skate wheel being defined between a lowest portion of one groove on one side of the interface zone and a lowest portion of another groove on another side of the interface zone, wherein the smallest width is arranged in the hub, and wherein the smallest width is less than a width of the connecting interface surface.

19. The wheel of claim 18, wherein the tread has a hardness in the range of between about 60 and about 85 Shore A; and wherein a lower most portion of each groove is at least one of curved, circular, and partially circular.

20. The wheel of claim 18, wherein the tread has a hardness in the range of between about 60 and about 85 Shore A; and wherein a widest portion of the hub, parallel to the rotation axis, is substantially approximately equal to a widest portion of the tread.

21. A skate wheel comprising:

a generally annular hub including an axis of rotation and a substantially cylindrical central surface adapted to cooperate with a mechanism for fixing the wheel on a shaft;

the hub including a first material;

a generally annular tread mounted to the hub and having at least one outer surface adapted to contact a ground surface;

the tread including a second material which is different from the first material and whose hardness is comprised between about 60 and about 85 Shore A;

a connecting interface zone being defined between the hub and the tread;

at least one annular groove having an axis which corresponds to the axis of rotation of the hub;

the at least one groove being arranged on at least one of side of the skate wheel in the area of the connecting interface zone; and the at least one groove having a profile, wherein the profile of the at least one groove comprises at least one of at least one straight profile and at least one curved profile, and wherein the interface zone includes an interface surface on which the tread rests, and wherein a width of the interface surface is smaller than about 80% of a width of the cylindrical central surface, and wherein the hub has a width in the area of the groove which is smaller than the width of the interface surface.

22. A skate wheel comprising:

a generally annular hub including an axis of rotation and a substantially cylindrical central surface adapted to cooperate with a mechanism for fixing the wheel on a shaft;

the hub including a first material;

a generally annular tread mounted to the hub and having at least one outer surface adapted to contact a ground surface;

the tread including a second material which is different from the first material and whose hardness is comprised between about 60 and about 85 Shore A;

a connecting interface zone being defined between the hub and the tread;

at least one annular groove having an axis which corresponds to the axis of rotation of the hub;

the at least one groove being arranged on at least one of side of the skate wheel in the area of the connecting interface zone; and the at least one groove having a profile, wherein the profile of the at least one groove comprises at least one of at least one straight profile and at least one curved profile, and wherein the profile includes a straight portion arranged on the tread and a curved portion arranged on the hub.

* * * * *